US006062831A

United States Patent [19]

Konishi et al.

[11] Patent Number: 6,062,831

[45] Date of Patent: May 16, 2000

[54] HIGH PRESSURE FUEL INJECTION PUMP

[75] Inventors: Keiichi Konishi; Keisaku Zenmei; Tatsuya Ikegami, all of Tokyo, Japan

[73] Assignee: Mitsubishi Denki Kabushiki Kaisha, Tokyo, Japan

[21] Appl. No.: 09/184,018

[22] Filed: Nov. 2, 1998

[30] Foreign Application Priority Data

May 28, 1998 [JP] Japan ..... 10-147577

[51] Int. Cl.[7] ..... F04B 11/00

[52] U.S. Cl. ..... 417/540; 417/540; 417/542

[58] Field of Search ..... 417/540, 542; 138/26, 30

[56] References Cited

U.S. PATENT DOCUMENTS 5,129,427 7/1992 White et al. ..... 138/30
5,205,326 4/1993 Paley et al. ..... 138/30
5,567,134 10/1996 Inoue ..... 417/490
5,718,488 2/1998 Schneider et al. ..... 303/87
5,971,728 10/1999 Konishi et al. ..... 417/540
5,980,221 11/1999 Uffelman ..... 417/540
6,004,119 12/1999 Hamasaki et al. ..... 418/181

*Primary Examiner*—Teresa Walberg
*Assistant Examiner*—Vinod D Patel
*Attorney, Agent, or Firm*—Sughrue, Mion, Zinn Macpeak & Seas, PLLC

[57] ABSTRACT

A high pressure fuel injection pump includes: a casing; a pump body arranged in the casing, the pump body having a piston and a sleeve reciprocating the piston therein; and a high pressure damper arranged in the casing and communicating with a discharge passage side of the pump body. The pump body and the high pressure damper are coaxially arranged in the casing.

8 Claims, 6 Drawing Sheets

HIGH PRESSURE FUEL INJECTION PUMP

BACKGROUND OF THE INVENTION

1. Field of the Invention

The present invention relates to a high pressure fuel injection pump having a high pressure damper.

2. Description of the Related Art

The Diesel engine is well known as a direct injection type engine, into the cylinder of which fuel is directly injected. However, even a spark-ignition engine (gasoline engine), into the cylinder of which fuel is directly injected, is recently proposed. In the above engine, into the cylinder of which fuel is directly injected, it is required that a sufficiently high fuel injection pressure is provided and also a pulsation of fuel pressure is small for the purpose of stabilization of injection of fuel. For the above reasons, a single cylinder type high pressure fuel pump is commonly used, the structure of which is simple and compact and the manufacturing cost of which is low. On the other hand, since the above single cylinder type fuel injection pump has only one plunger, a pulsation of fuel pressure discharged from the fuel injection pump is considerably large. In order to absorb this pulsation of fuel pressure, there is proposed a metallic bellows type pulsation absorbing device or a diaphragm type pulsation absorbing device.

As an example of the related art, FIG. 7 shows a high pressure fuel feed pump having a high pressure damper which is a pulsation absorbing device. In FIG. 7, reference numeral 1 is a high pressure fuel feed pump, which is mounted on a housing of an engine not shown in the drawing and driven by a cam not shown in the drawing rotating at a speed of ½ of the engine speed. Reference numeral 2 is a casing of this high pressure fuel feed pump. Reference numeral 3 is a suction passage formed in this casing 2. Reference numeral 4 is a discharge passage formed in this casing 2 and communicated with a fuel injection valve not shown in the drawing. Reference numeral 5 is a drain passage formed in the above casing 2.

Reference numeral 6 is an accommodating recess formed at a lower end portion of the above casing 2. This accommodating recess 6 includes a screw portion 6*a* and a bottom portion 6*b*. Reference numeral 7 is an accommodating recess formed at an upper end portion of the above casing 2. This accommodating recess 7 includes a screw portion 7*a*. Reference numeral 8 is an accommodating recess formed at a right end portion of the above casing 2.

Reference numeral 9 is a sleeve arranged in the accommodating recess 6 of the above casing 2. The sleeve 9 is composed of a cylinder portion 9*a* and a fixing portion 9*b* formed into a flange-shape. Reference numerals 10 and 11 are respectively a plate A and a plate B arranged between a bottom portion 6*b* of the accommodating recess 6 of the casing 2 and the sleeve 9. A reed valve 12 is interposed between these plates A and B.

On each of the above plates A and B, there are formed a suction hole communicating with the suction passage 3, a discharge hole communicating with the discharge passage 4, and a drain hole communicating with the drain passage 5. On the other hand, in the reed valve 12, there are provided a suction valve, a discharge valve which make fuel pass in one direction, and a drain hole, wherein the suction valve and the discharge valve are respectively located at positions corresponding to the suction hole and the discharge hole.

Reference numeral 13 is a cylindrical piston reciprocatingly arranged in a cylinder portion 9*a* of the sleeve 9. The cylindrical piston 13 forms a fuel pressurizing chamber 14 together with the cylinder portion 9*a*. Reference numeral 15 is a compression coil spring arranged in the fuel pressurizing chamber 14. Reference numeral 16 is a spring holder for positioning the compression coil spring 15.

Reference numeral 17 is a housing arranged round the sleeve 9 in such a manner that the housing surrounds the sleeve 9. The housing 17 is formed into a substantial bowl shape having no bottom. At the outer circumferential portion of the housing 17, there is provided a cylindrical edge portion 17*a*. Reference numeral 18 is a holder fixed at an end portion of the piston 13 on the opposite side of the fuel pressurizing chamber 14. Reference numeral 19 is a bellows made of metal arranged between the holder 18 and the housing 17. When fuel has leaked out from between the piston 13 and the sleeve 9, the fuel is accommodated inside the bellows 19.

Reference numeral 20 is a tappet attached to an end portion of the piston 13 on the opposite side of the fuel pressurizing chamber 14. The tappet 20 is driven by a cam not shown in the drawing.

Reference numeral 21 is a bracket for fixing the high pressure fuel pump 1 to a housing and others of an engine not shown in the drawing. Reference numeral 22 is a clamp screw fastened to the screw portion 6*a* of the casing 2. The housing 17, sleeve 9, plate A 10, plate B 11 and reed valve 12 are pushed and fixed to a bottom portion of the accommodating recess 6 by the clamp screw 22.

Reference numeral 23 is a heat insulating plate attached to the bracket 21. The pump body 24 of the high pressure fuel feed pump is composed of the above components from the sleeve 9 to the heat insulating plate 23.

Reference numeral 25 is a high pressure damper attached to the accommodating recess 7 of the casing 2. The high pressure damper 25 is communicated with the discharge passage 4 on the high pressure side and composes a high pressure accumulator which is a pulsation absorbing device of fuel. Reference numeral 26 is a high pressure container. Reference numeral 27 is a plate accommodated in a bottom portion of the accommodating recess 7 of the casing 2. Reference numeral 28 is a thin flexible disk-shaped diaphragm made of metal which forms a high pressure chamber 29 in cooperation with the case 26. A circumferential edge portion of the diaphragm 28 is interposed between the case 26 and the plate 27 so that the circumferential edge portion can be sealed.

Reference numeral 30 is a ring-shaped clamp screw and fastened to the screw portion 7*a* of the casing 2, so that the case 26, diaphragm 28 and plate 27 are pushed and fixed to a bottom portion of the accommodating recess 7 by the clamp screw 30.

Reference numeral 31 is a low pressure damper attached to the accommodating recess 8 of the casing 2. The low pressure damper 31 is communicated with the suction passage 3 on the low pressure side, so that the pulsation of fuel can be absorbed by the low pressure damper 31. Reference numeral 32 is a cylindrical housing attached to a bottom portion of the accommodating recess 8 of the casing 2. Reference numeral 33 is a lid to tightly close up this housing. Reference numeral 34 is a bellows, one side of which is fixed to this lid 33.

In the high pressure fuel injection pump composed as described above, the piston 13 is pushed to the tapper 20 side by the compression coil spring 15. The tappet 20 is driven by a cam driven by an engine. By transmitting a force from the rotation of the cam, and the piston 13 is reciprocated in the cylinder portion 9*a*.

When the piston 13 is lowered, fuel is sucked from the suction passage 3 into the fuel pressurizing chamber 14 via the reed valve 12. When the piston 13 is raised, a suction valve of the reed valve 12 is closed. On the other hand, the discharge valve is opened, so that fuel in the fuel pressurizing chamber 14 is discharged from the discharge passage 4. Fuel, which has leaked out from between the piston 13 and the sleeve 9, is stored inside the bellows 19 and returned to a fuel tank not shown via the drain passage 5.

In the apparatus of the related art described above, in order to seal up the end surface of the sleeve 9, plate A, plate B, reed valve 12 and casing 2, the clamp screw 22 is fastened with respect to the pump body 24 by a clamping force not lower than 2000 kg, so that the sealing property can be provided. Also, in order to tightly attach the high pressure damper 25 to the pump body 24, the clamp screw 30 is fastened by a clamping force not lower than 2000 kg.

However, as shown in FIG. 8, an attaching center of the pump body 24 and an attaching center of the high pressure damper 25 are offset to each other, in view of the arrangement of the fuel passage and the thickness of the casing 2. Therefore, when the high pressure damper 25 is fastened to the casing 2, a force is given to the casing 2 as shown by a broken line in FIG. 8. Accordingly, a portion to which the plate of the pump body 24 is attached is deformed upward. Therefore, gaps are formed among plate A, plate B and casing 2. As a result, fuel leaks from these gaps, and the pump efficiency is deteriorated.

The surface of the casing 2 onto which the pump body 24 is attached is machined by means of cutting. Accordingly, as shown in FIGS. 9 and 10, the cutting grooves become communicating passages, and the low pressure passage and the high pressure passage are communicated with each other, that is, fuel leaks from the cutting grooves and the pump efficiency is lowered.

Further, when a gap is formed between plate A and plate B, abrasion is caused on the plates and the durability is deteriorated.

SUMMARY OF THE INVENTION

The present invention has been accomplished to solve the above problems. It is an object of the present invention to provide a fuel injection pump which can prevent fuel from leaking out from the pump body attaching portion of the casing without being affected by the fastening of the high pressure damper, so that the casing and the plate can be tightly sealed to each other, and the pump efficiency and durability can be enhanced.

The foregoing object of the invention is achieved by providing a high pressure fuel injection pump including: a casing; a pump body arranged in the casing, the pump body having a piston and a sleeve reciprocating the piston therein; and a high pressure damper arranged in the casing and communicating with a discharge passage side of the pump body, wherein the pump body and the high pressure damper are coaxially arranged in the casing.

In addition, according to the present invention, the pump body and the high pressure damper may be respectively attached to the casing with clamp screws.

Further, according to the present invention, the pump body and the high pressure damper may be attached into accommodating recesses respectively formed in the casing with clamp screws of the substantially same diameter.

Further, according to the present invention, a surface of the casing onto which the pump body is attached may be formed into a convex shape.

Further, according to the present invention, a surface of the casing onto which the pump body is attached may be formed into a twill pattern.

Moreover, according to the present invention, a surface of the casing onto which the pump body is attached may be formed into a twill pattern by means of milling.

Further, according to the present invention, a diameter of the attaching portion of the casing to which the high pressure damper may be attached is smaller than a diameter of the attaching portion of the casing to which the pump body is attached.

Further, according to the present invention, the high pressure damper is at least one of a diaphragm type and a resonator.

BRIEF DESCRIPTION OF THE DRAWINGS

Similar reference characters denote corresponding features consistently throughout the attached drawings. The preferred embodiments of this invention will be described in detail, with reference to the following figures, wherein.

DETAILED DESCRIPTION OF THE PREFERRED EMBODIMENTS

A preferred embodiment of the invention will be described with reference to the drawings.

(EMBODIMENT 1)

Figure 1:
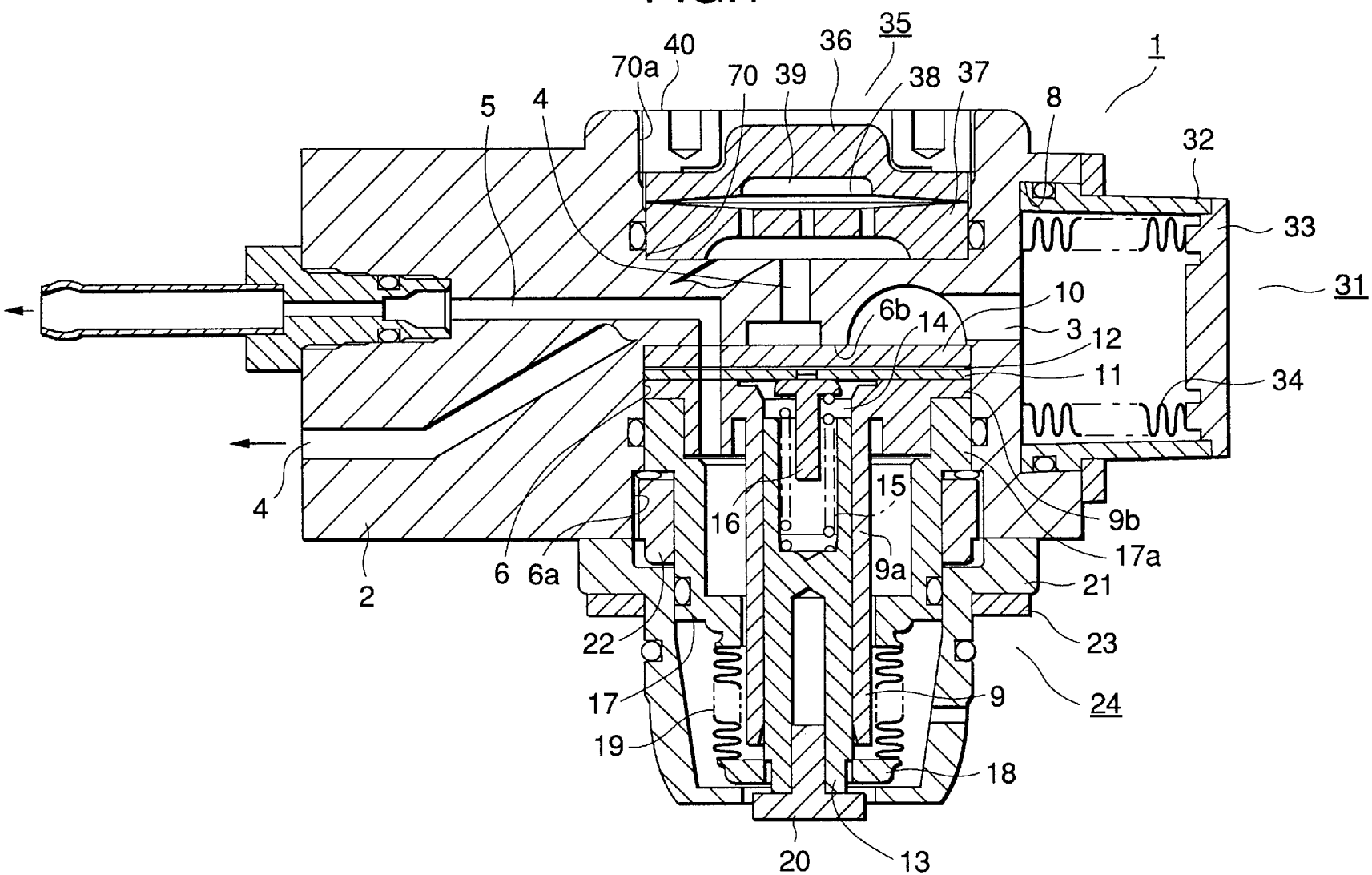
FIG. 1 is a cross-sectional view showing a high pressure fuel feed pump according to Embodiment 1 of the present invention.

FIG. 1 is a cross-sectional view showing a high pressure fuel feed pump of the present invention.

Figure 2:
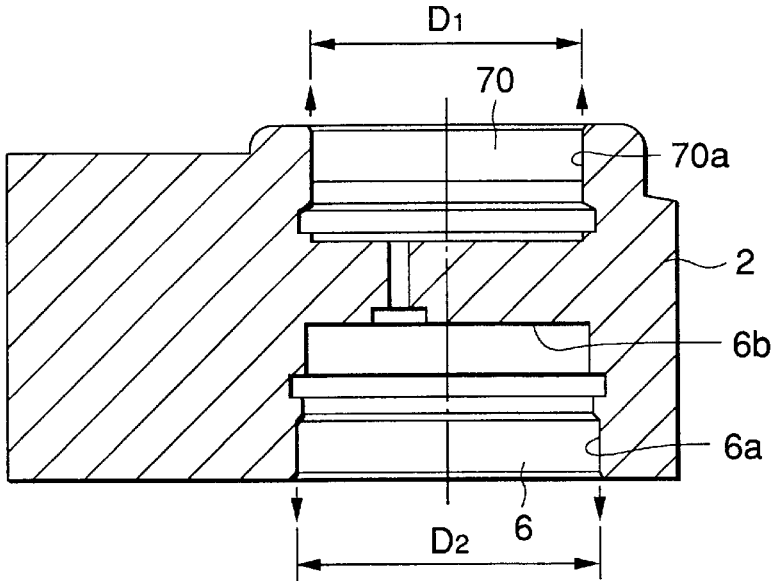
FIG. 2 is a cross-sectional view showing a casing of the high pressure fuel pump according to Embodiment 1 of the present invention.

FIG. 2 is a cross-sectional view showing a casing of the high pressure fuel feed pump of the present invention.

In FIG. 1, reference numeral 70 is an accommodating recess formed in an upper end portion of the casing 2. The accommodating recess 70 is arranged on the same axis as that of the accommodating recess 6 to which the pump body 24 is attached. Inner diameter $D_1$ of the accommodating recess 70 is substantially the same as inner diameter $D_2$ of the accommodating recess 6.

Reference numeral **70*a* is a screw portion formed at an upper end of the accommodating recess 70. Reference numeral 35 is a high pressure damper attached to the accommodating recess 70 of the casing 2. The high pressure damper 35 is communicated with the discharge passage 4 on the high pressure side and forms a high pressure-accumulator which functions as a pulsation absorbing device. The high pressure damper 35 is arranged in the casing 2 on the same axis as that of the pump body 24**.

Reference numeral 36 is a case which is a high pressure container. Reference numeral 37 is a plate accommodated in the bottom portion of the accommodating recess 70 of the casing 2. Reference numeral 38 is a thin flexible metallic disk-shaped diaphragm forming the high pressure chamber 39 in cooperation with the case 36. A circumferential edge portion of the diaphragm 37 is interposed between the case 36 and the plate 37 so that they can be supported and tightly sealed. Reference numeral 40 is a ring-shaped clamp screw, the diameter of which is substantially the same as that of the clamp screw 22 of the pump body 24. The clamp screw 40 is engaged with the screw portion 70*a* of the casing 2, so that the case 36, diaphragm 38 and plate 37 are pushed and fixed to the bottom portion of the accommodating recess 70.

In Embodiment 1 of the present invention composed as described above, the high pressure damper 35 is arranged on the same axis as that of the pump body 24, and further the diameter of the clamp screw 40 is substantially the same as that of the clamp screw 22 of the pump body 24. Therefore, even if the high pressure damper 35 is fastened into the accommodating recess 70 of the casing 2 by the clamp screw 40, the plate attaching portion of the accommodating recess 6 of the pump body 24 is not affected by the clamping stress, that is, the plate attaching portion of the accommodating recess 6 of the pump body 24 is not deformed.

Accordingly, unlike the conventional arrangement, the plate attaching portion of the accommodating recess 6 of the pump body 24 in the casing 2 is not deformed. Therefore, it is possible to prevent the occurrence of a problem in which gaps are generated among plate A, plate B and casing 2.

(EMBODIMENT 2)

Figure 3:
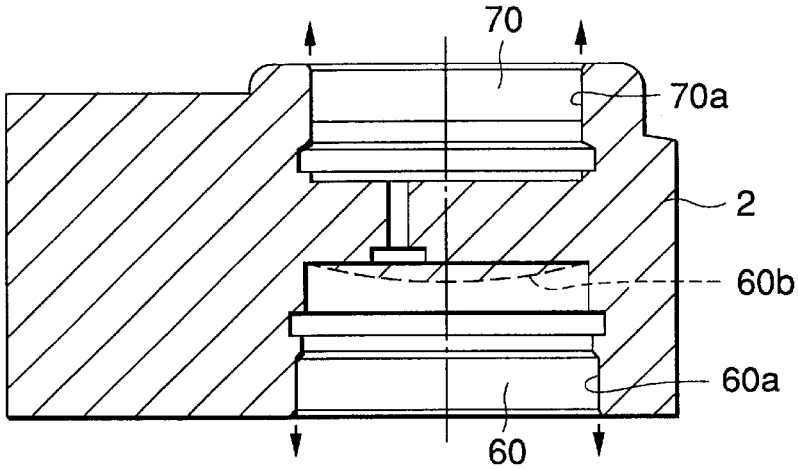
FIG. 3 is a cross-sectional view showing a casing of the high pressure fuel pump according to Embodiment 2 of the present invention.

FIG. 3 is a cross-sectional view showing a casing of the high pressure fuel feed pump of Embodiment 2 of the present invention.

As shown in FIG. 3, in this Embodiment 2, the bottom portion 60*b* of the accommodating recess 60, which is a plate attaching portion of the pump body 24, is machined so as to protrude downward. This accommodating recess 60 is arranged on the same axis as that of the accommodating recess 70 for accommodating the high pressure damper 35, and the inner diameter of this accommodating recess 60 is substantially the same as that of the accommodating recess 70.

Reference numeral 60*a* is a screw portion formed at the lower end portion of the accommodating recess 60. The diameter of the screw portion 60*a* is substantially the same as that of the screw portion 70*a* for attaching the high pressure damper 35.

In Embodiment 2 composed as described above, the bottom portion 60*b*, which is a plate attaching portion of the accommodating recess 60, is previously machined in such a manner that it is protruded and formed into a convex shape. Therefore, when the pump body 24, except for the bracket 21 and the heat insulating plate 23, is accommodated in the accommodating recess 60 and engaged with the screw portion 60*a* of the casing 2 and clamped by the clamp screw 22, plate A, plate B and reed valve 12 are closely contacted with the protruding plate attaching surface of the accommodating recess 60. Therefore, the sealing property can be improved.

(EMBODIMENT 3)

Figure 4:
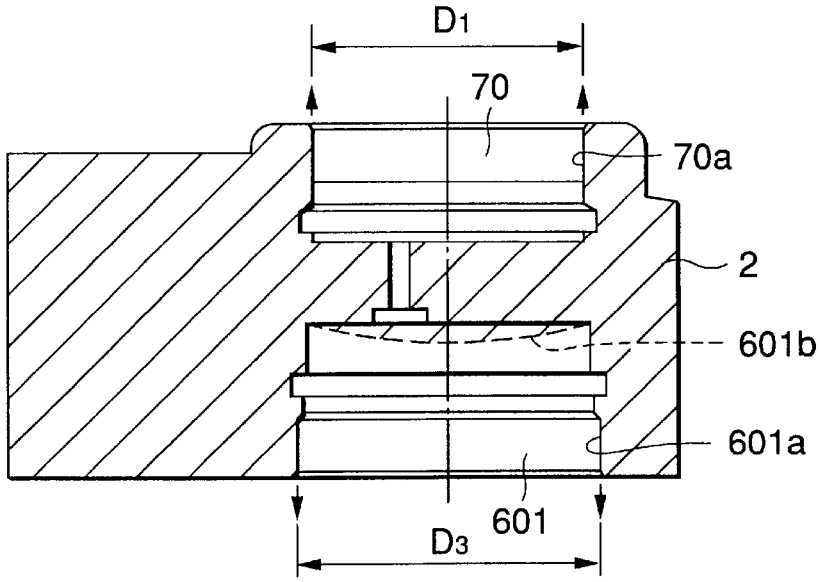
FIG. 4 is a cross-sectional view showing a casing of the high pressure fuel pump according to Embodiment 3 of the present invention.

FIG. 4 is a cross-sectional view showing a casing of the high pressure fuel feed pump of Embodiment 3 of the present invention.

In FIG. 4, reference numeral 601 is an accommodating recess in which the pump body 24 is accommodated. This accommodating recess 601 is arranged on the same axis as that of the accommodating recess 70 for accommodating the high pressure damper 35, and inner diameter $D_3$ of this accommodating recess 601 is larger than inner diameter $D_1$ of the accommodating recess 70.

Reference numeral 601*a* is a screw portion formed at the lower end of the accommodating recess 601. Reference numeral 601*b* is a bottom portion which forms a plate attaching portion of the accommodating recess 601.

In Embodiment 3 arranged as described above, the attaching diameter of the high pressure damper 35 is smaller than that of the pump body 24 in the casing 2. Therefore, when the high pressure damper 35 is clamped into the accommodating recess 70 of the casing 2 by the clamp screw 40, the bottom portion 601*b* of the accommodating recess 601 for attaching the pump body 24 is protruded downward as shown in FIG. 4, so that plate A, plate B and reed valve 12 can be closely contacted with this protruding plate attaching surface, and the sealing property can be improved.

(EMBODIMENT 4)

Figure 5:
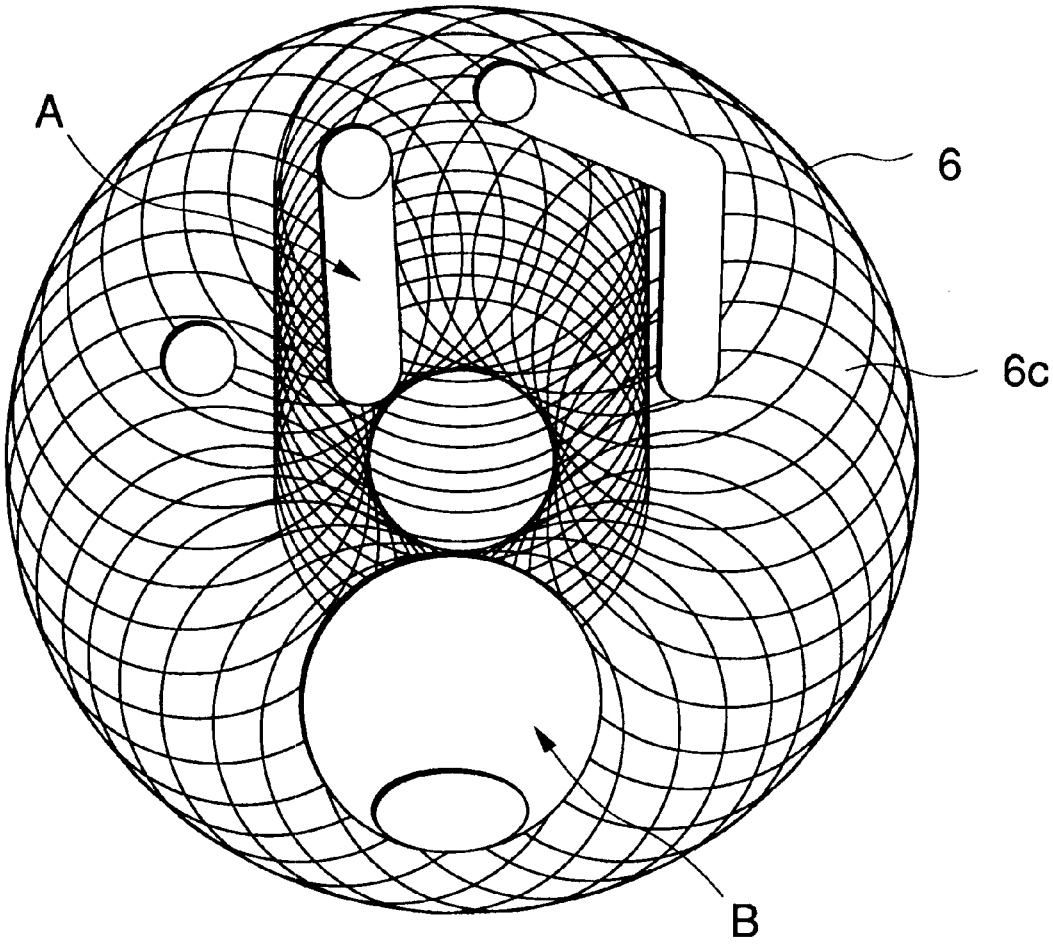
FIG. 5 is a lower surface view showing a casing of the high pressure fuel pump according to Embodiment 4 of the present invention.

FIG. 5 is a lower surface view showing a bottom portion which is a plate attaching surface of the accommodating recess of the high pressure fuel feed pump in Embodiment 4 of the present invention. In FIG. 5, reference numeral 6*c* is a bottom portion which is a plate attaching surface of the accommodating recess 6 for attaching the pump body 24. The surface of the bottom portion 6*c* is machined by means of milling and a twill pattern is formed on the surface.

In Embodiment 4 arranged as described above, machining of twill is conducted on the surface of the bottom portion 6*c*. Therefore, high pressure passage A and low pressure passage B are not communicated with each other via the mesh formed on the surface in the process of machining. Accordingly, no fuel leaks from the mesh formed on the surface in the process of machining, and the pump efficiency can be improved.

(EMBODIMENT 5)

Figure 6:
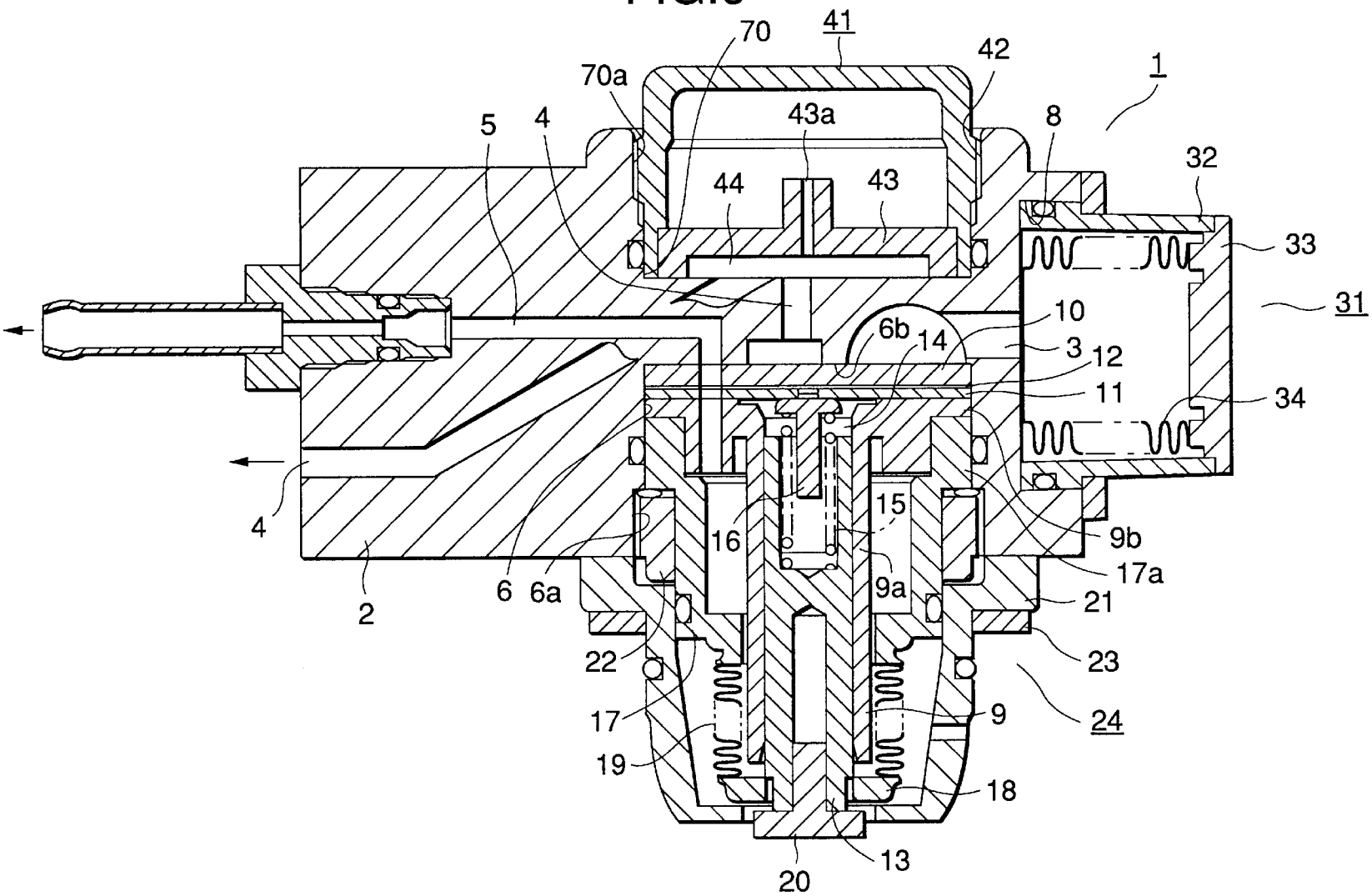
FIG. 6 is a cross-sectional view showing a high pressure fuel pump according to Embodiment 5 of the present invention.
Figure 7:
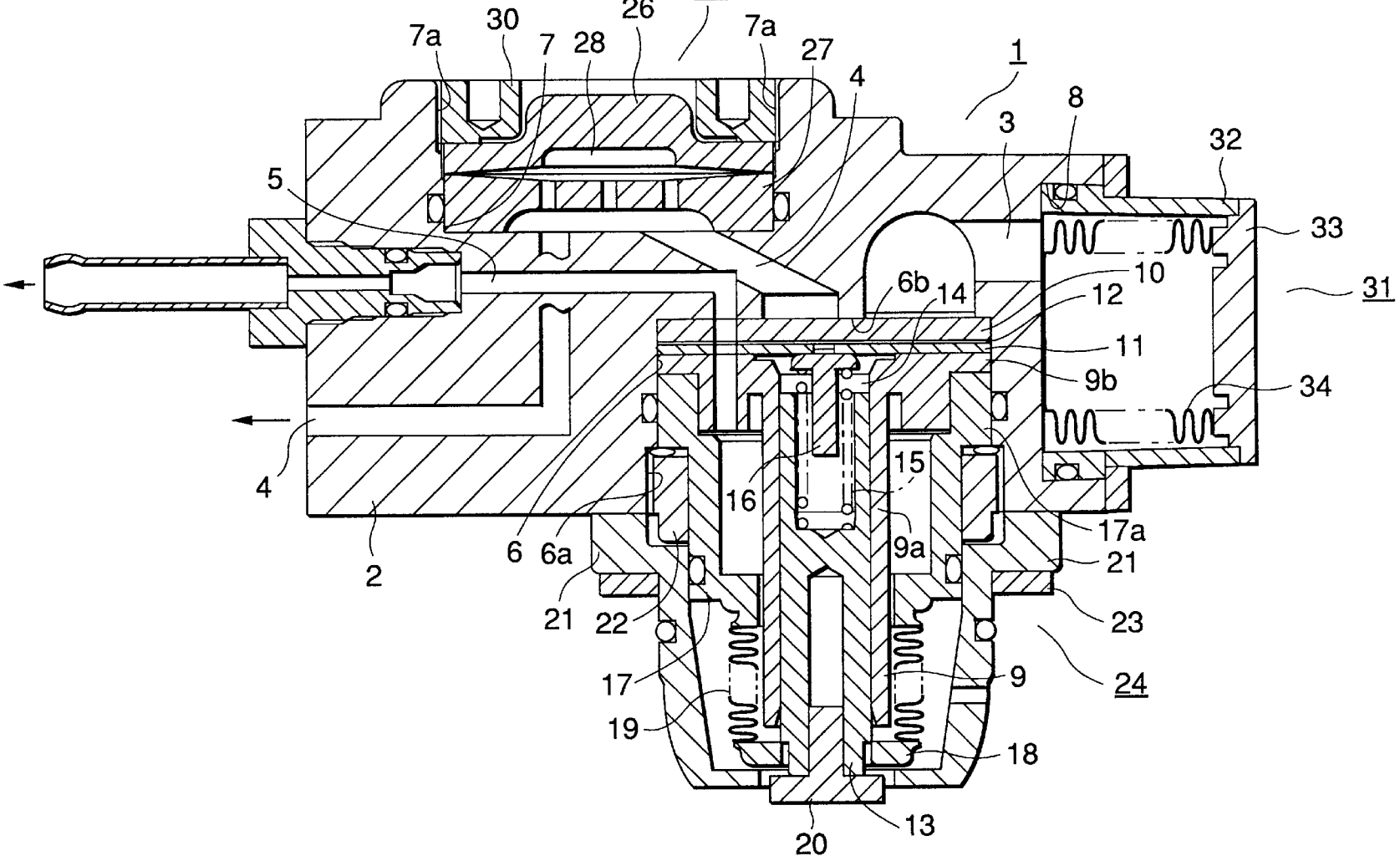
FIG. 7 is a cross-sectional view showing a conventional high pressure fuel injection pump.
Figure 8:
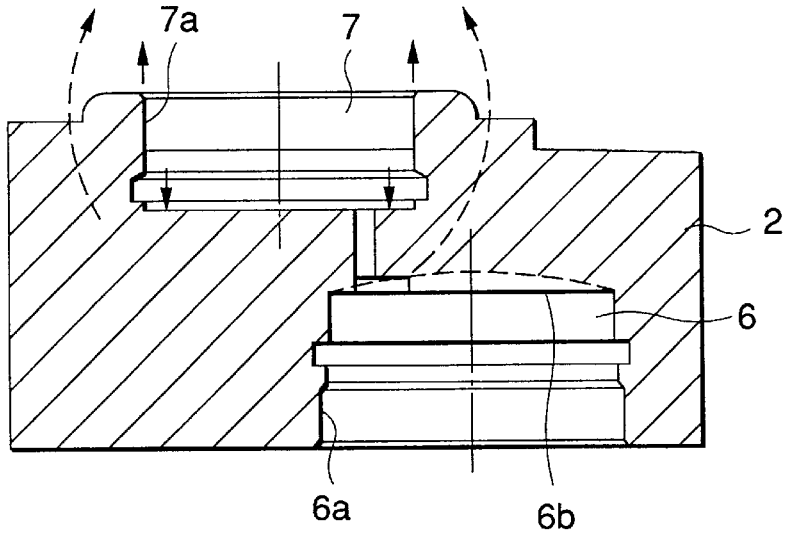
FIG. 8 is a cross-sectional view showing a casing of the conventional high pressure fuel injection pump.
Figure 9:
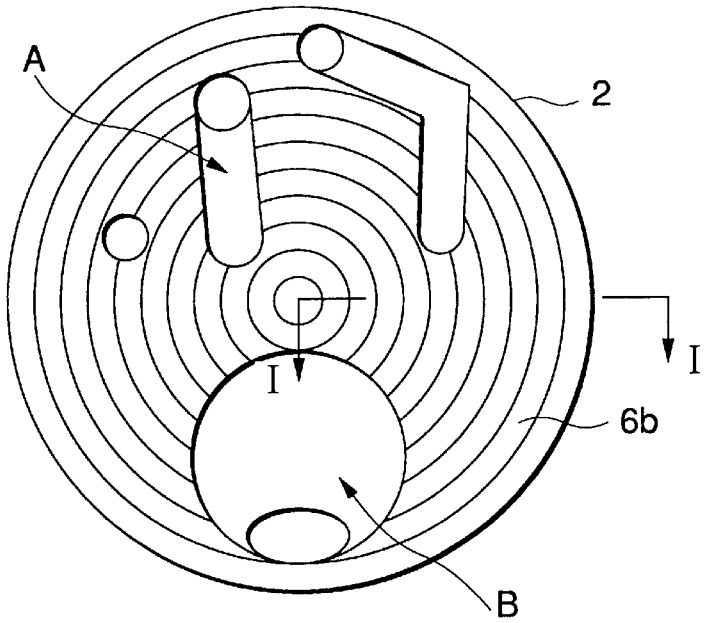
FIG. 9 is a lower surface view showing a casing of the conventional high pressure fuel injection pump.
Figure 10:
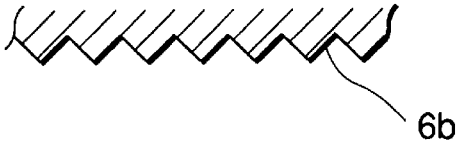
FIG. 10 is a cross-sectional view taken on line I—I in FIG. 9.

FIG. 6 is a cross-sectional view showing a high pressure fuel feed pump of Embodiment 5 of the present invention.

In FIG. 6, reference numeral 41 is a resonator forming a high pressure damper. The resonator 41 is screwed into the accommodating recess 70 of the casing 2 and communicated with the discharge passage 4 on the high pressure side, so that it can absorb a pulsation of fuel which is a constant frequency. The resonator 41 is arranged in the casing 2 on the same axis as that of the pump body 24. The attaching diameter of the resonator 41 in the casing 2 is substantially the same as that of the pump body 24.

Reference numeral 42 is a case and has a screw portion 42*a* which is screwed to the screw portion 70*a* of the accommodating recess 70. Reference numeral 42 is a plate and has a small communicating passage 43*a* at the center. At a lower portion of this plate 43, a buffer container 44 is composed.

In Embodiment 5 composed as described above, the resonator 41 is used as a high pressure damper. Also in this embodiment, in the same manner as that of Embodiment 1 of the present invention, it is possible to avoid a deformation of the plate attaching portion of the accommodating recess 6 of the pump body 24 in the casing 2, and no gaps are generated among plate A, plate B and casing 2. Therefore, the problems caused by the gaps generated among plate A, plate B and casing 2 can be solved.

According to the invention, a high pressure fuel injection pump includes: a pump body arranged in a casing, having a piston and a sleeve in which the piston reciprocates; and a high pressure damper arranged in the casing on the discharge passage side of the pump, wherein the pump body and the high pressure damper are coaxially arranged in the casing. Therefore, when the high pressure damper is attached to the casing, it is possible to solve the problems as follows. No deformation is caused in the attaching portion of the casing to which the pump is attached, and no gaps are generated between the plate attaching surface of the pump body and the plate. Therefore, it is possible to avoid a deterioration of the pump efficiency caused by the leakage of fuel, and further it is possible to improve the durability of the pump.

Further, in the high pressure fuel injection pump, the pump body and the high pressure damper may be respectively attached to the casing with clamp screws. When the pump body and the high pressure damper are clamped with each other by the clamp screws, no deformation is generated in the plate attaching portion of the casing to which the pump body is attached. Consequently, no gaps are formed between the plate attaching surface of the pump body in the casing and the plate. Therefore, it is possible to prevent the deterioration of the pump efficiency caused by the leakage of fuel, and also it is possible to prevent the deterioration of the pump durability. Therefore, the pump efficiency can be improved and the durability can be enhanced in the high pressure fuel injection pump.

Further, in the high pressure fuel injection pump, the pump body and the high pressure damper may be attached into accommodating recesses respectively formed in the casing with clamp screws of the substantially same diameter. Accordingly, it is possible to prevent a deformation of the accommodating recess of the pump body caused by the clamp screw, and also it is possible to prevent a deformation of the accommodating recess of the high pressure damper caused by the clamp screw. Especially, it is possible to prevent a deformation of the plate attaching portion of the accommodating recess of the pump body in the casing, and no gaps are generated between the plate attaching surface of the pump body and the plate. Accordingly, it is possible to prevent a deterioration of the pump efficiency caused by the leakage of fuel from the gaps, and also it is possible to prevent a deterioration of the pump durability caused by the leakage of fuel from the gaps. Therefore, it is possible to provide a high pressure fuel injection pump, the efficiency and the durability of which can be enhanced.

Further, in the high pressure fuel injection pump, a surface of the casing onto which the pump body may be attached is formed into a convex shape. Accordingly, it is possible to closely attach the pump body onto the pump body attaching surface in the casing. Therefore, the sealing property can be improved, and no fuel leaks from the attaching surface of the pump body, and the pump efficiency can be enhanced.

Moreover, in the high pressure fuel injection pump, a surface of the casing onto which the pump body is attached may be formed into a twill pattern. Therefore, the high pressure passage and the low pressure passage are not communicated with each other via the mesh formed in the process of machining of the attaching surface of the pump body. It is possible to avoid a leakage of fuel from the mesh formed in the process of machining. Therefore, the pump efficiency can be enhanced.

Further, in the high pressure fuel injection pump, a surface of the casing onto which the pump body is attached may be formed into a twill pattern by means of milling. Therefore, it is possible to avoid a leakage of fuel when a simple machining is conducted, and it is also possible to enhance the pump efficiency at low cost.

Further, in the high pressure fuel injection pump, a diameter of the attaching portion of the casing to which the high pressure damper is attached may be smaller than a diameter of the attaching portion of the casing to which the pump body is attached. Due to the above construction, the pump body attaching surface in the casing can be protruded to the pump body side. Therefore, the pump body and the pump body attaching surface in the casing can be closely contacted with each other. Therefore, the sealing property can be enhanced, and it is possible to prevent a deterioration of the pump efficiency caused by the leakage of fuel.

Moreover, in the high pressure fuel injection pump, the high pressure damper may be of the diaphragm type or the resonator type. Therefore, either of the diaphragm type or the resonator type can be selected in accordance with the pulsation of fuel. Consequently, it is possible to positively absorb the pulsation of fuel. Further, it is possible to prevent a deterioration of the pump efficiency caused by the leakage of fuel and also it is possible to prevent a deterioration of the pump durability.

What is claimed is:

1. A high pressure fuel injection pump comprising:

a casing;

a pump body arranged in said casing, said pump body having a piston and a sleeve reciprocating said piston therein; and a high pressure damper arranged in said casing and communicating with a discharge passage side of said pump body, wherein said pump body and said high pressure damper are coaxially arranged in said casing.

2. A high pressure fuel injection pump according to claim 1, wherein said pump body and said high pressure damper are respectively attached to said casing with clamp screws.

3. A high pressure fuel injection pump according to claim 2, wherein said pump body and said high pressure damper are attached into accommodating recesses respectively formed in said casing with said clamp screws of the substantially same diameter.

4. A high pressure fuel injection pump according to claim 1, wherein a surface of said casing onto which said pump body is attached is formed into a convex shape.

5. A high pressure fuel injection pump according to claim 1, wherein a surface of said casing onto which said pump body attached is formed into a twill pattern.

6. A high pressure fuel injection pump according to claim 5, wherein a surface of said casing onto which said pump body is attached is formed into a twill pattern by means of milling.

7. A high pressure fuel injection pump according to claim 1, wherein a diameter of an attaching portion of said casing to which said high pressure damper is attached is smaller than a diameter of an attaching portion of said casing to which said pump body is attached.

8. A high pressure fuel injection pump according to claim 1, wherein said high pressure damper is one of a diaphragm type and a resonator.

* * * * *